US005143042A

United States Patent [19]

Scheid

[11] Patent Number: 5,143,042

[45] Date of Patent: Sep. 1, 1992

[54] IGNITION DEVICE FOR INTERNAL COMBUSTION ENGINES

[75] Inventor: Günter Scheid, Pfakofen, Fed. Rep. of Germany

[73] Assignee: Siemens Aktiengesellschaft, Munich, Fed. Rep. of Germany

[21] Appl. No.: 740,281

[22] Filed: Aug. 5, 1991

[30] Foreign Application Priority Data

Aug. 6, 1990 [EP] European Pat. Off. ..... 90115095.3

[51] Int. Cl.[5] ..... F02P 17/00

[52] U.S. Cl. ..... 123/630; 324/399

[58] Field of Search ..... 123/481, 630; 73/117.3; 324/388, 399

[56] References Cited

U.S. PATENT DOCUMENTS

| | | | |
|---|---|---|---|
| 3,942,102 | 3/1976 | Kuhn et al. | 324/399 |
| 4,558,280 | 12/1985 | Koehl et al. | 324/399 |
| 4,918,389 | 4/1990 | Schleupen et al. | 324/399 |
| 4,987,771 | 1/1991 | Iwata | 123/481 X |
| 5,045,796 | 9/1991 | Bentel et al. | 324/399 |

FOREIGN PATENT DOCUMENTS

| | | |
|---|---|---|
| 0277468 | 8/1988 | European Pat. Off. . |
| 2752244 | 6/1979 | Fed. Rep. of Germany . |
| 2759154 | 7/1979 | Fed. Rep. of Germany . |
| 1573073 | 5/1969 | France . |
| 2237071 | 2/1975 | France . |
| 55-29046 | 3/1980 | Japan . |
| 1456193 | 11/1976 | United Kingdom . |
| 2071935 | 9/1981 | United Kingdom . |

*Primary Examiner*—Tony M. Argenbright

*Attorney, Agent, or Firm*—Herbert L. Lerner; Laurence A. Greenberg

[57] ABSTRACT

An ignition device for internal combustion engines includes at least one ignition coil having primary terminals and first and second secondary terminals separated from the primary terminals. The first secondary terminal leads directly or through a distributor to at least one spark plug. A common point is connected to the second secondary terminal. A sensor is connected between the common point and a negative pole of a supply voltage source. A measuring line is connected to the common point. An ignition control circuit is connected to the measuring line for evaluating measurement signals being picked up at the measuring line. A series circuit of a voltage limiter and a resistor has a connecting point therebetween. The series circuit is connected parallel to the sensor. A diagnosis line leads from the connecting point to the ignition control circuit and carries diagnosis signals to be picked up and evaluated in the ignition control circuit.

5 Claims, 2 Drawing Sheets

IGNITION DEVICE FOR INTERNAL COMBUSTION ENGINES

Figure 1:
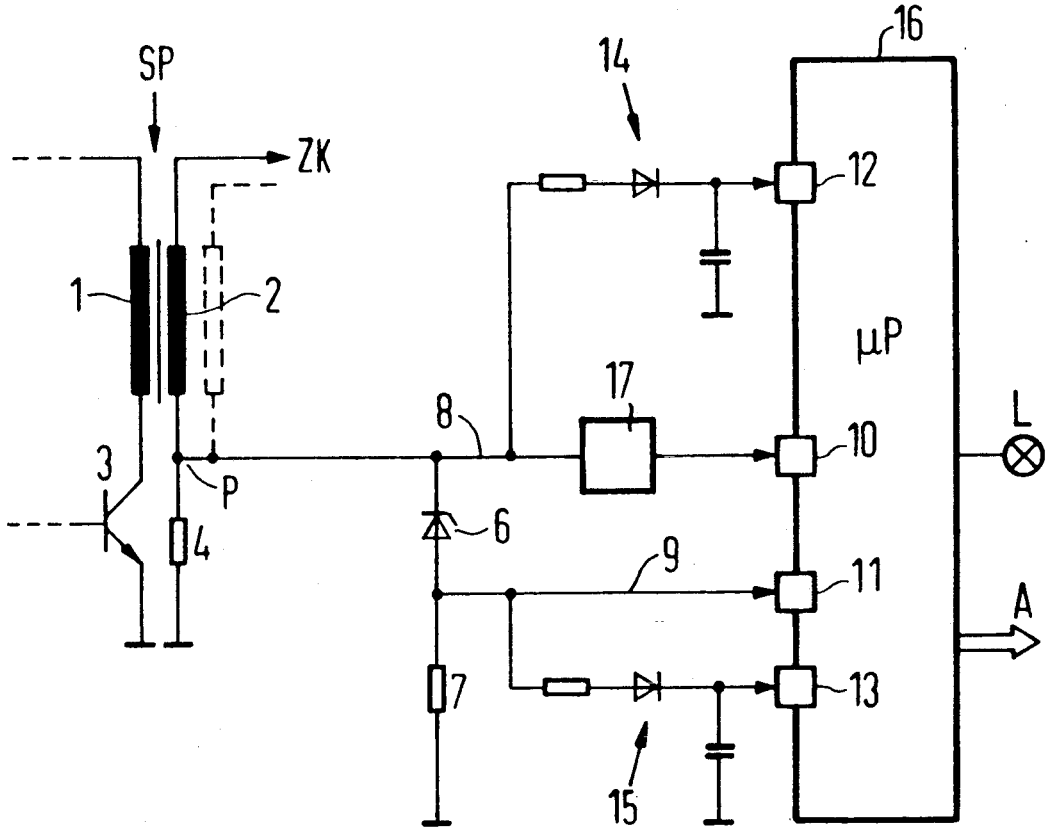

The invention relates to an ignition device for internal combustion engines, having at least one ignition coil with first and second secondary terminals separated from primary terminals, the first secondary terminal leading directly or through a distributor to one or more spark plugs, the second secondary terminal of the single ignition coil or of all of the ignition coils, as applicable, leading to a common point and from there through a sensor to the negative pole of a supply voltage source, and a measuring line leading from the common point to an ignition control circuit, wherein measurement signals that can be picked up at the measuring line can be evaluated in the ignition control circuit.

Such a device is disclosed in German Published, Non-Prosecuted Application DE-OS 27 59 154.

In the known ignition device, feedback control of the spark discharge duration of the spark plugs is provided. It is attained by measuring the duration of the spark discharge current which is ascertained through a sensor, comparing it with a command value, and readjusting the closing duration of the primary winding of the ignition coil on the basis of the outcome of the comparison.

The connection through the sensor between the second secondary terminal, or in the case of a plurality of ignition coils between their common point, and the negative pole of the supply voltage, at times may be broken. In that case, although experience shows that ignition still always takes place, nevertheless it cannot be optimal. That has a deleterious effect on the combustion process in the cylinders. The measurement input of the subsequent ignition control circuit can be damaged by the increased voltage, and the electronic control system of the engine control system can be impeded in its regular operation.

It is accordingly an object of the invention to provide an ignition device for internal combustion engines, which overcomes the hereinafore-mentioned disadvantages of the heretofore-known devices of this general type and to do so in such a way that this error can be recognized, and a resultant error signal can be used to protect the ignition control circuit.

With the foregoing and other objects in view there is provided, in accordance with the invention, an ignition device for internal combustion engines, comprising at least one ignition coil having primary terminals, first and second secondary terminals separated from the primary terminals, the first secondary terminal leading directly or through a distributor to one or more spark plugs, a common point connected to the second secondary terminal of the ignition coil or coils, a sensor connected between the common point and a negative pole of a supply voltage source, a measuring line connected to the common point, an ignition control circuit connected to the measuring line for evaluating measurement signals being picked up at the measuring line, a series circuit of a voltage limiter and a resistor with a connecting point therebetween, the series circuit being connected parallel to the sensor, and a diagnosis line leading from the connecting point to the ignition control circuit and carrying diagnosis signals to be picked up and evaluated in the ignition control circuit.

In accordance with another feature of the invention, there is provided a second measuring line connected between the common point and the ignition control circuit, and a peak rectifier connected in the second measuring line.

In accordance with a further feature of the invention, there is provided a second diagnosis line connected between the connection point between the voltage limiter and the resistor to the ignition control circuit, and a peak rectifier connected in the second diagnosis line.

In accordance with a concomitant feature of the invention, the ignition control circuit or device includes a microprocessor.

Other features which are considered as characteristic for the invention are set forth in the appended claims.

Although the invention is illustrated and described herein as embodied in an ignition device for internal combustion engines, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

Figure 2A:
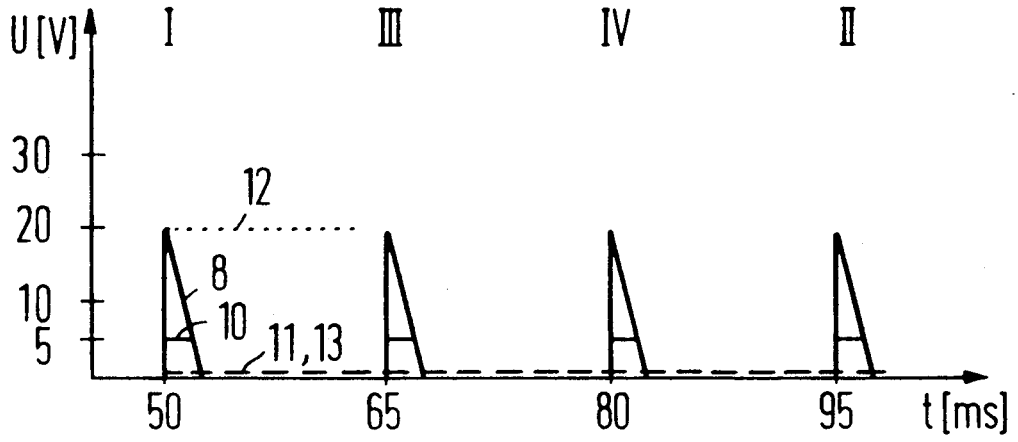
Figure 2B:
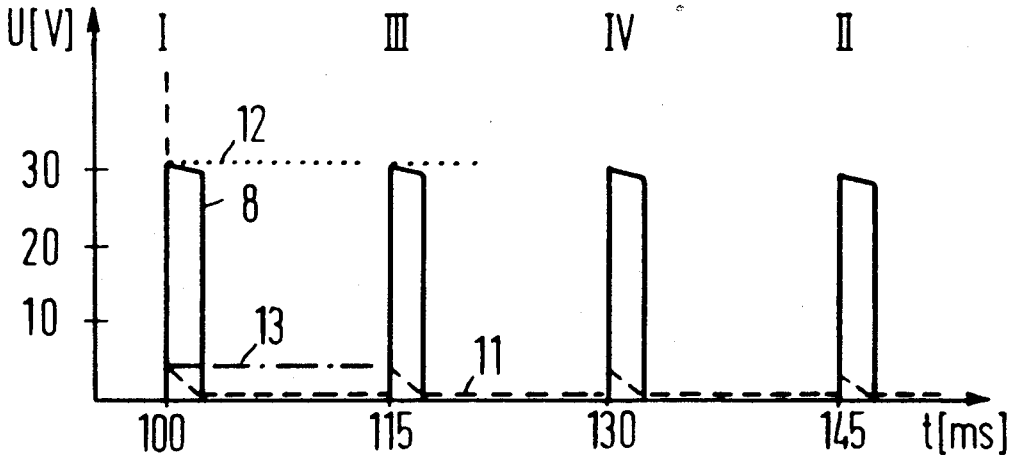

FIG. 1 is a schematic and block circuit diagram of an ignition device according to the invention;

FIG. 2*a* is a diagram of measurement and diagnosis signals in error-free operation; and FIG. 2*b* is a diagram of measurement and diagnosis signals in an error mode.

Referring now to the figures of the drawing in detail and first, particularly, to FIG. 1 thereof, there is seen a primary winding 1 of an ignition coil SP which is triggered through a switch transistor 3. A first secondary terminal of a secondary winding 2 leads to one or more spark plugs ZK, and a second secondary terminal is connected through a sensor 4 to a negative pole of a non-illustrated supply voltage source. A further secondary coil of possible further ignition coils which is suggested in the drawing, has second secondary terminals which lead to a common point P.

A measuring line 8 leads from this common point P through a signal former circuit 17 to a connection pin 10 of a microprocessor 16, serving as an ignition control circuit included in the ignition control device. The signal former circuit 17 converts the measuring signals into rectangular signals having a harmless voltage amplitude.

A series circuit of a voltage limiter 6 and a resistor 7 is connected parallel to the sensor 4. The voltage limiter 6 is constructed as a Zener diode.

A diagnosis line 9 leads from a connecting point between the Zener diode 6 and the resistor 7 to a connection pin 11 of the microprocessor 16.

In addition to or instead of the connection of the measuring line 8 to the connection pin 10, the common point P is selectively connected by a second measuring line through a peak rectifier 14 to a connection pin 12 of the microprocessor 16. A non-illustrated signal former circuit may likewise be provided between the peak rectifier 14 and the connection pin 12. In addition to or instead of the connection of the diagnosis line 9 to the connection pin 11, a second diagnosis line is selectively connected from the connection point between the voltage limiter 6 and the resistor 7 through a peak rectifier 15 to a connection pin 13 of the microprocessor 16. An indicator light L and an arrow A symbolically represent signals activated by the microprocessor 16. These signals will be discussed in greater detail below.

FIG. 2 shows diagrams of the measurement and diagnosis signals, in error-free operation in FIG. 2*a*, and in an error mode in FIG. 2*b*.

In FIG. 2, measurement and diagnosis signals are represented by numerals 8 through 13, which correspond to lines or connection pins in FIG. 1, at which these signals appear. The cylinders of the engine with which the ignition pulses of the measurement and diagnosis signals are associated, are identified by Roman numerals. This cylinder association is effected in a known manner through camshaft and crankshaft pulses. In this way, the measurement and diagnosis signals can be evaluated separately for each cylinder.

Each time the current in the primary winding 1 of the ignition coil SP is interrupted by the switch transistor 3, a rapidly rising ignition pulse is induced in the secondary winding 2. The current flowing through the spark plugs ZK generates voltage pulses at the sensor 4 that appear as measurement signals on the measuring line 8. In this regard, reference is made to the signal course 8 for error-free operation in FIG. 2*a* and for the error mode consequent to an interruption at the sensor 4 in FIG. 2*b*. The measurement signals are converted into approximately rectangular signals 10 seen in FIG. 2*a*, through the signal former circuit 17.

As a standard for the ignition spark duration, the duration of the measurement signals is counted out in real time by the microprocessor 16, in a known manner.

In error-free operation, the pulses on the measuring line 8 attain a voltage amplitude that does not attain the conducting-state threshold of the Zener diode 6. A zero signal thus appears at the connection pins 11 and 13, as represented by dashed lines 11, 13 in FIG. 2*a*.

In the error mode, the amplitude of the measurement signals on the measuring line 8 attains a multiple of the value in error-free operation, so that the Zener diode becomes conducting upon each measurement signal pulse 8 and limits the voltage. As a result, a diagnosis signal, represented by dashed-line pulses 11 in FIG. 2*b*, appears at both the resistor 7 and the connection pin 11.

This diagnosis signal is evaluated by the microprocessor 16.

At a given number of faulty ignition pulses, an indicator light L is switched on, and/or an error is displayed or stored in memory in the microprocessor 16 and output as an error signal, represented by the arrow A of FIG. 1, for further processing.

Since the duration of the measurement signals and thus of the ignition sparks is ascertained by the microprocessor 16 in real time, it may be difficult to ascertain both the amplitude of the measurement signal and the presence of a diagnosis signal in real time as well. For this reason, the measurement signal and/or the diagnosis signal are carried through the respective peak rectifiers 14 and 15 to the connection pins 12 and 13 of the microprocessor 16, where they can be evaluated at a later time, during the cycle time of the applicable cylinder (until the ignition pulse of the next cylinder), when the microprocessor is no longer occupied with real-time measurement. Reference is made in this regard to dotted lines 12 in FIG. 2*a* and a dot-dash line 13 in FIG. 2*b*. Shortly before the appearance of the next ignition pulse, a discharge of the peak value rectifier capacitors is effected, if necessary, by means of a reset pulse.

I claim:

1. An ignition device for internal combustion engines, comprising at least one ignition coil having primary terminals, first and second secondary terminals separated from said primary terminals, said first secondary terminal leading to at least one spark plug, a common point connected to said second secondary terminal, a sensor connected between said common point and a negative pole of a supply voltage source, a measuring line connected to said common point, an ignition control circuit connected to said measuring line for evaluating measurement signals being picked up at said measuring line, a series circuit of a voltage limiter and a resistor with a connecting point therebetween, said series circuit being connected parallel to said sensor, and a diagnosis line leading from said connecting point to said ignition control circuit and carrying diagnosis signals to be picked up and evaluated in said ignition control circuit.

2. The ignition device according to claim 1, including a distributor connected between said first secondary terminal and the at least one spark plug.

3. The ignition device according to claim 1, including a second measuring line connected between said common point and said ignition control circuit, and a peak rectifier connected in said second measuring line.

4. The ignition device according to claim 1, including a second diagnosis line connected between said connection point between said voltage limiter and said resistor to said ignition control circuit, and a peak rectifier connected in said second diagnosis line.

5. The ignition device according to claim 1, wherein said ignition control circuit includes a microprocessor.

* * * * *